United States Patent [19]

Wulf

[11] 4,412,813

[45] Nov. 1, 1983

[54] ROTARY HEARTH FURNACE AND METHOD OF LOADING AND UNLOADING THE FURNACE

[75] Inventor: Karl A. Wulf, Rockford, Ill.

[73] Assignee: Alco Standard Corporation, Valley Forge, Pa.

[21] Appl. No.: 345,031

[22] Filed: Feb. 2, 1982

[51] Int. Cl.[3] ..... F27D 3/00; F27B 9/16

[52] U.S. Cl. ..... 432/11; 414/152; 414/158; 432/52; 432/138; 432/239

[58] Field of Search ..... 432/5, 11, 52, 138, 432/239; 414/158, 152

[56] References Cited

U.S. PATENT DOCUMENTS

| | | | |
|---|---|---|---|
| 2,013,905 | 9/1935 | Adams, Jr. | 432/10 |
| 2,622,861 | 12/1952 | Talley | 432/52 |
| 2,820,621 | 1/1958 | Hess | 432/52 |
| 3,212,765 | 10/1965 | Ipsen | 266/5 |
| 3,475,786 | 11/1969 | Pearson | 18/5 |
| 4,170,815 | 10/1979 | Tokitsu | 432/5 |

FOREIGN PATENT DOCUMENTS

| | | | |
|---|---|---|---|
| 2800522 | 7/1979 | Fed. Rep. of Germany | 432/138 |

*Primary Examiner*—John J. Camby

*Attorney, Agent, or Firm*—Leydig, Voit, Osann, Mayer & Holt, Ltd.

[57] ABSTRACT

The hearth of the furnace is indexed in such a manner that successive workpieces in a loading position are loaded in non-adjacent stations of the hearth during one revolution and are loaded in intervening stations during one or more subsequent revolutions. The method of loading and indexing the hearth enables a uniform temperature distribution to be more easily maintained in the furnace and provides flexibility in locating an unloading position relative to the loading position.

18 Claims, 10 Drawing Figures

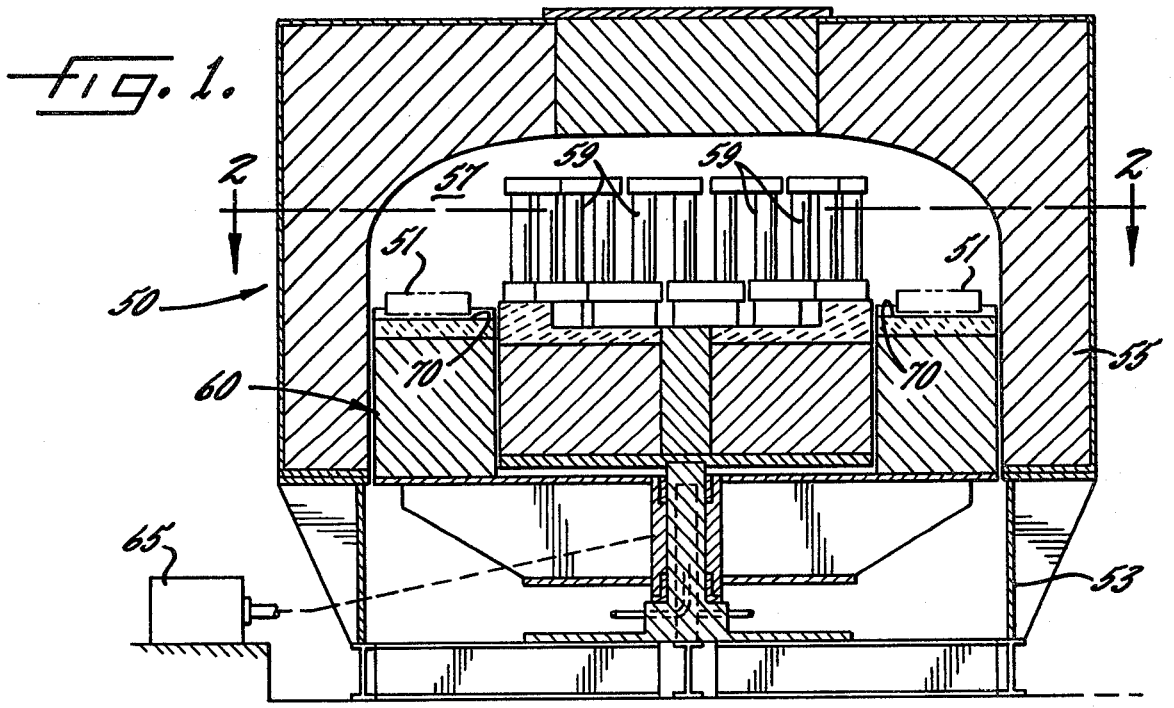
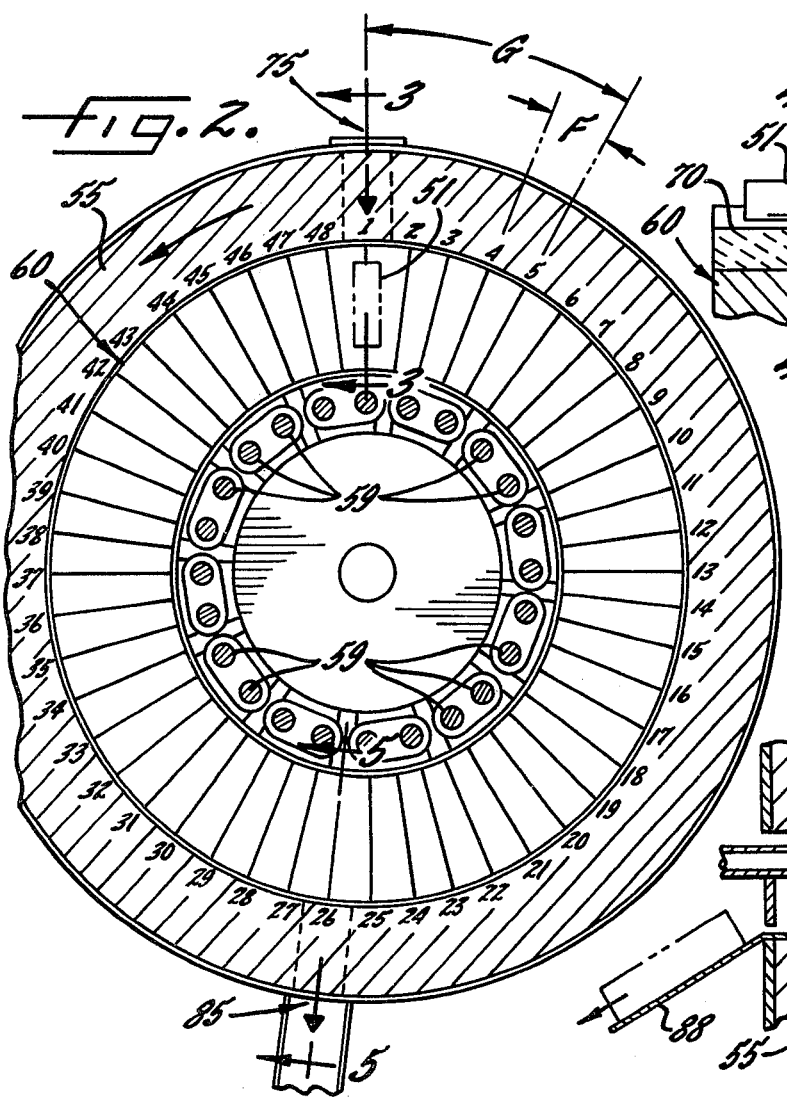
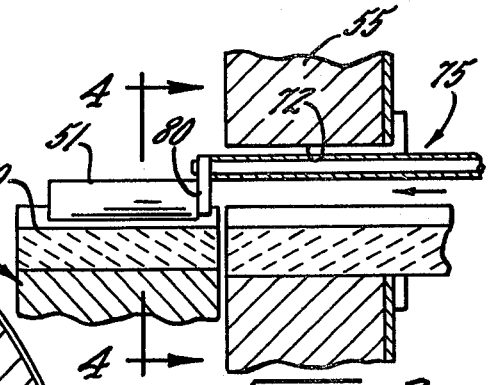
Fig. 3.
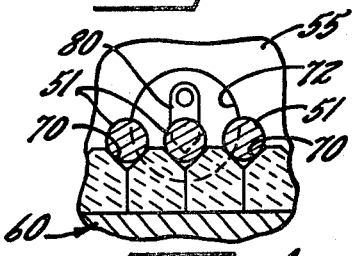
Fig. 4.
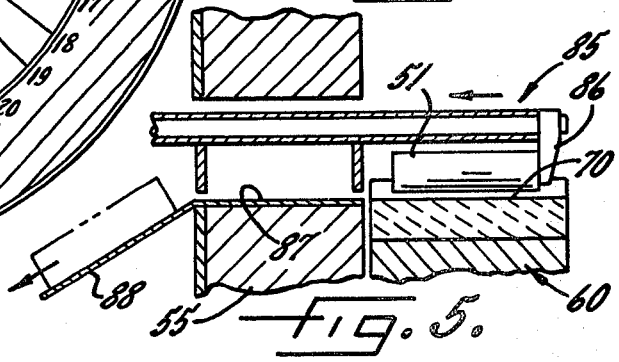
Fig. 5.

ROTARY HEARTH FURNACE AND METHOD OF LOADING AND UNLOADING THE FURNACE

BACKGROUND OF THE INVENTION

This invention relates to a rotary hearth furnace of the type having a heating chamber and having a rotatable hearth in the chamber. At a loading position, workpieces are placed in angularly spaced stations on the hearth and are advanced around a circular path in the chamber. During the rotation, the workpieces are heated by heating means disposed within the chamber. After being heated, the workpieces are removed from the hearth at an unloading position which is spaced angularly from the loading position. Once the hearth has been filled or substantially filled with workpieces, a heated workpiece is removed from the hearth at the unloading position each time a cold workpiece is placed on the hearth at the loading position.

In most conventional rotary hearth furnaces, the hearth is intermittently indexed through equal steps each having an angular length equal to the angular spacing between adjacent workpiece stations so that successive workpieces are loaded into adjacent stations when the hearth successively dwells. In addition, the unloading position is usually located closely adjacent the loading position so that each workpiece may be removed from the hearth after the hearth has rotated approximately through a complete revolution.

The loading arrangement used in conventional rotary hearth furnaces results in several cold workpieces being grouped together in the initial zone of the furnace chamber while several extremely hot workpieces are grouped together in the final zone of the chamber. Difficulty has been encountered, therefore, in maintaining temperature uniformity around the chamber since the group of cold workpieces absorbs significantly more heat than the angularly spaced group of extremely hot workpieces. Also, the close proximity of the loadng and unloading positions of a conventional rotary hearth furnace requires a considerable amount of floor space adjacent one section of the furnace and makes it difficult to employ automated equipment for loading and unloading the hearth.

SUMMARY OF THE INVENTION

The general aim of the present invention is to provide a new and improved rotary hearth furnace which is loaded and unloaded in a unique manner so as to enable a more uniform temperature distribution to be maintained around the furnace chamber and to enable the unloading position to be located either substantially diametrically opposite from the loading position or at various selected areas relative to the loading position.

A more detailed object is to provide a furnace with an intermittently rotatable hearth which is indexed in a novel manner so as to cause non-adjacent stations of the hearth to be loaded during one revolution of the hearth and to cause intervening stations to be loaded during one or more subsequent revolutions. In this way, cold workpieces are never placed on the hearth in direct side-by-side relation but instead newly loaded cold workpieces are interspersed among previously loaded hot workpieces. As a result, the various zones of the furnace may be more easily maintained at a uniform temperature since cold and hot workpieces are not separately grouped in different zones. The unique manner in which the hearth is loaded and indexed also enables flexibility in the location of the unloading position and enables the unloading position to be located remote from and substantially in line with the loading position so as to permit the efficient use of available floor space, to permit an efficient flow of the workpieces through the furnace and to permit the use of sophisticated and automated loading and unloading equipment.

The invention also resides in the manner in which the hearth is indexed to enable a hearth with a given number of stations to be filled in the fewest possible number of revolutions while still keeping the loading and unloading sequence consistent with the principles of the invention.

These and other objects and advantages of the invention will become more apparent from the following detailed description when taken in conjunction with the accompanying drawings.

BRIEF DESCRIPTION OF THE DRAWINGS

FIG. 1 is a cross-sectional view taken vertically through a new and improved rotary hearth furnace incorporating the unique features of the present invention.

FIG. 2 is a fragmentary cross-sectional view taken substantially along the line 2—2 of FIG. 1.

FIG. 3 is a fragmentary cross-sectional view taken substantially along the line 3—3 of FIG. 2.

FIG. 4 is a fragmentary cross-sectional view taken substantially along the line 4—4 of FIG. 3.

FIG. 5 is a fragmentary cross-sectional view taken substantially along the line 5—5 of FIG. 2.

DETAILED DESCRIPTION OF THE PREFERRED EMBODIMENT

Figure 6:
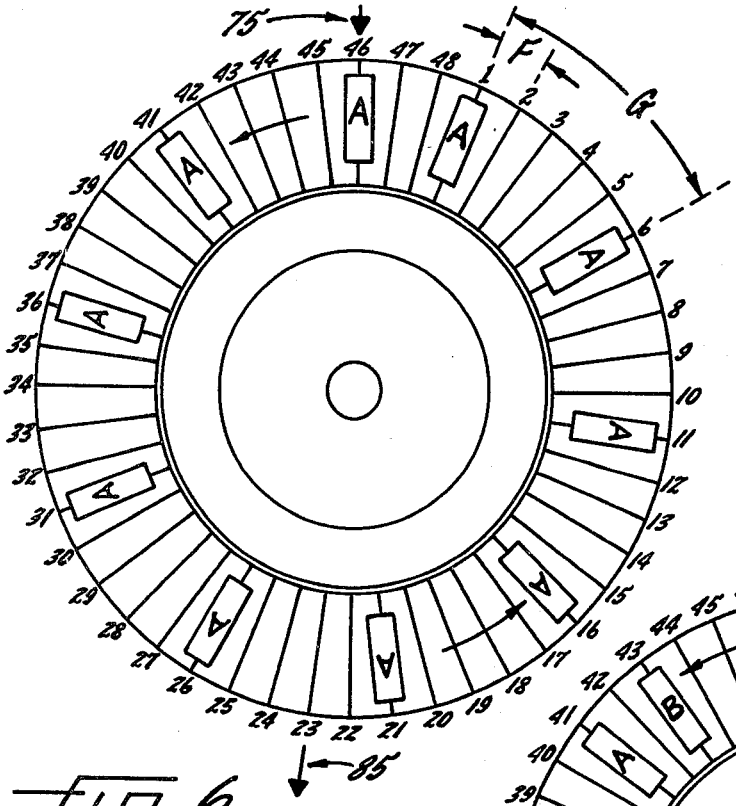
FIGS. 6 to 10 are diagrammatic views somewhat similar to FIG. 2 and schematically show the successive steps which are followed during loading of the hearth.

As shown in the drawings for purposes of illustration, the invention is embodied in a rotary hearth furnace 50 for heating workpieces 51. The workpieces may, for example, be cylindrical rods or billets which are heated to a high temperature in the furnace prior to being forged.

In many respects, the furnace is of conventional construction and comprises a main base 53 which supports an enclosure 55 made of refractory material. Defined within the enclosure is a circular heating chamber 57 containing a stationary array of heating elements 59 which are spaced from one another around a circle. The heating elements preferably are electrical resistance elements or are graphite elements.

A circular ring-like hearth 60 encircles the heating elements 59 and is supported on the base 53 to rotate about a vertical axis. A suitable drive mechanism 65 (shown schematically in FIG. 1) is operably connected to the hearth and, in this particular instance, is effective to index the hearth intermittently through equal steps of predetermined angular distance. The construction of the drive mechanism per se does not form part of the present invention. One suitable type of drive mechanism is disclosed in Pearson U.S. Pat. No. 3,475,786.

Formed in the upper side of the hearth 60 are several angularly spaced and generally V-shaped pockets 70 (FIGS. 3 to 5) which define work stations for receiving the billets 51. In the particular hearth which has been illustrated, there are forty-eight identical work pockets (pockets Nos. 1 to 48) around the hearth with the pockets being spaced equally from one another by an angular distance F (FIG. 2) of 7.5 degrees. Each time the hearth 60 dwells, a billet 51 is delivered through an opening 72 (FIGS. 3 and 4) in the enclosure 55 and is loaded into a pocket 70 which stops at a loading position indicated generally by the reference numeral 75 (FIGS. 2 and 3). The hearth then is indexed to advance that billet around the chamber 57 and to advance an empty pocket to the loading position to receive a billet when the hearth again dwells. Loading of the billets may be effected by highly automated loading mechanism. For purposes of simplicity, the billets have been shown schematically as being loaded by a reciprocating pusher 80 (FIG. 3) which shoves the billets through the opening 72 and into the pockets, the pusher being located at the loading position 75.

After each billet 51 has been in the chamber 57 for a predetermined period of time and has been heated to a predetermined temperature, the billet is removed from the hearth 60 when the billet dwells at an unloading position 85 (FIGS. 2 and 5) which is spaced angularly from the loading position 75. Again, highly sophisticated automated equipment may be used to effect rapid unloading and subsequent transfer of the billets. Since that equipment does not per se form part of the present invention, a simple reciprocating and rotatable puller 86 (FIG. 5) has been shown schematically in the drawings for unloading the billets by pulling the billets outwardly through an opening 87 in the enclosure 55 and for discharging the billets down a downwardly inclined chute 88.

In accordance with the present invention, successive billets 51 at the loading position 75 are not loaded into adjacent pockets 70 of the hearth 60 as is conventional practice but instead are loaded into non-adjacent pockets during one revolution of the hearth and then are loaded into intervening pockets during subsequent revolutions. As a result, cold and hot billets are interspersed with one another around the hearth rather than a group of stone cold billets being located on one section of the hearth and a group of extremely hot billets being located on a different section of the hearth. Thus, the various zones of the furnace chamber 57 may be more easily maintained at a uniform temperature. In addition, the unloading position 85 may be located at various positions relative to the loading position 75 so as to enable the floor space surrounding the furnace 50 to be used efficiently and flexibly and to enable sophisticated and highly automated loading, unloading and transfer equipment to be strategically spaced around the furnace.

More specifically, the foregoing is achieved by causing the hearth 60 to be indexed through steps each having an angular distance G (FIG. 2) which is a whole multiple of the angular distance F between the pockets 70 and which is selected such that non-adjacent pockets stop at the loading position 75 during one revolution of the hearth while intervening pockets stop at the loading position during subsequent revolutions until all of the pockets have stopped at the loading position and have received a billet 51. In this particular instance where there are 48 pockets with a spacing F of 7.5 degrees, the hearth is indexed through steps each having an angular distance G of 37.5 degrees. Any substantial number of pockets, either even or odd, may be provided, however, in carrying out the principles of the invention as long as the index distance G is a whole multiple of the angular spacing F and as long as the index distance G is established such that the quotients resulting from dividing 360 degrees by G and by ½ G are non-integers. For example, the hearth 60 may have 63 pockets 70 with an angular spacing F of approximately 5.714 degrees and with an index distance G of approximately 28.57 degrees.

With the hearth 60 having 48 pockets 70 and being indexed through a distance G of 37.5 degrees, every fifth pocket stops at the loading position 75 when the hearth dwells. Let it be assumed that the hearth is rotated in a counterclockwise direction (FIG. 2 and FIGS. 6 to 10), is initially empty and initially dwells with pocket No. 1 at the loading position 75 as shown in FIG. 2. Once this pocket has been loaded, the hearth is indexed through nine steps of distance G to cause pockets Nos. 6, 11, 16, 21, 26, 31, 36, 41 and 46 to stop at the loading station and receive billets 71 indicated as A (FIG. 6). Upon completion of the ninth step (and approximately one revolution), pocket No. 1 dwells three stations short of the loading position 75 while pocket No. 46 dwells at the loading position and receives a billet indicated as A as shown in FIG. 6.

Figure 7:
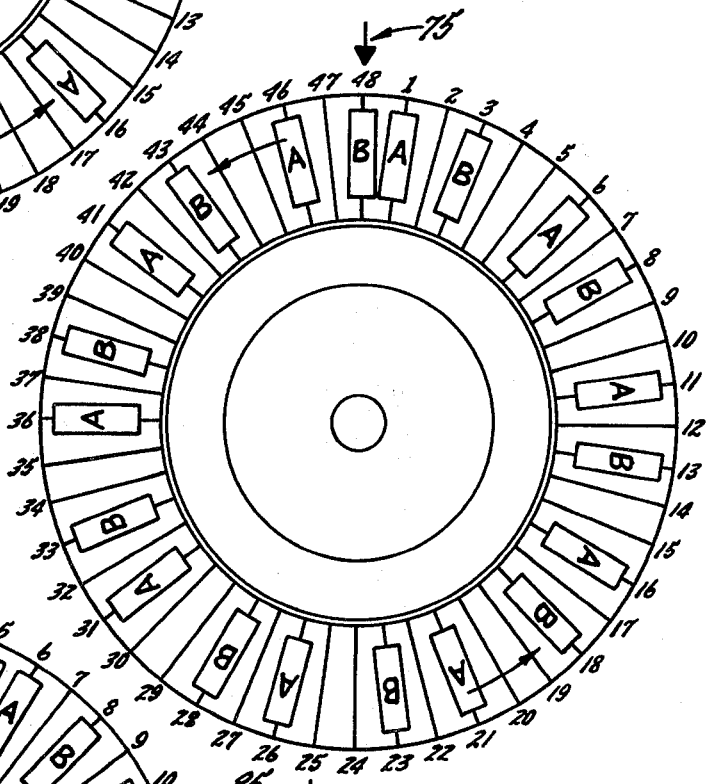

During ten subsequent steps of distance G, pockets Nos. 3, 8, 13, 18, 23, 28, 33, 38, 43 and 48 stop successively at the loading position 75 to receive billets indicated as B in FIG. 7. When pocket No. 48 stops at the loading position 75, the hearth 60 has been rotated through almost two revolutions or a total of 712.5 degrees with pocket No. 1 dwelling one station short of the loading position (see FIG. 7).

Figure 8:
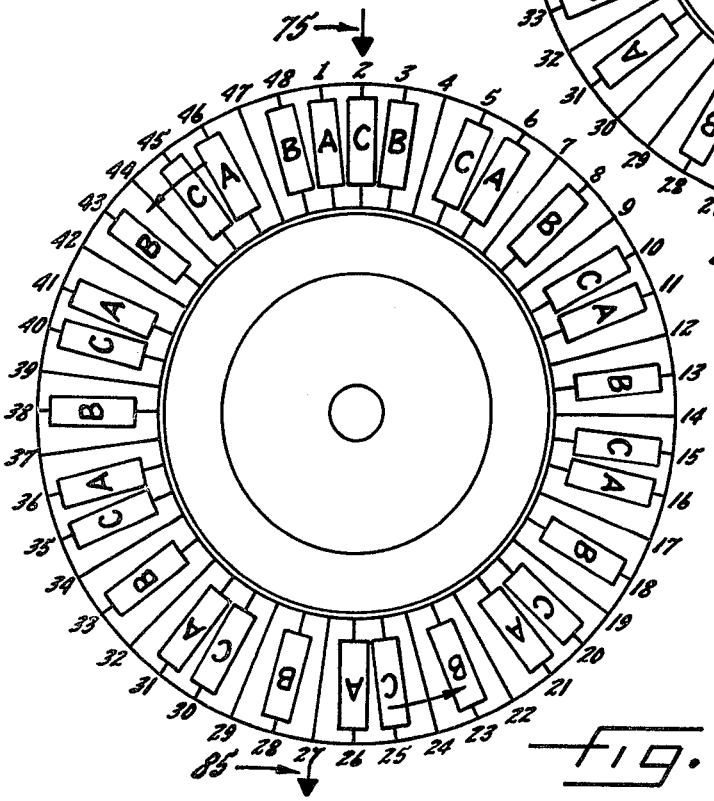

During the next series of ten steps of distance G, pockets Nos. 5, 10, 15, 20, 25, 30, 35, 40, 45 and 2 successively stop at the loading position 75 and receive billets indicated as C in FIG. 8. When pocket No. 2 dwells at the loading position 75, the hearth 60 has been rotated through a total of 1087.5 degrees or just slightly more than three revolutions and pocket No. 1 dwells one station beyond the loading position as shown in FIG. 8.

Figure 9:
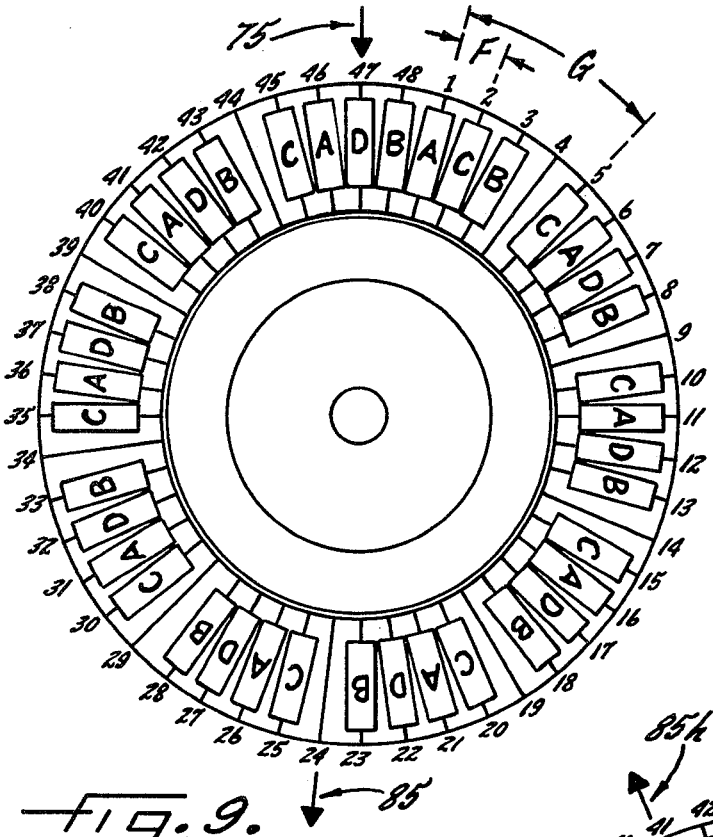

Pockets Nos. 7, 12, 17, 22, 27, 32, 37, 42, and 47 stop successively at the loading position 75 and receive billets indicated as D (FIG. 9) during the next nine indexes of the hearth 60. With pocket No. 47 in the loading position 75, the hearth has rotated through 1425 degrees or almost four revolutions. At that time, pocket No. 1 is located two stations short of the loading position 75 as shown in FIG. 9.

Figure 10:
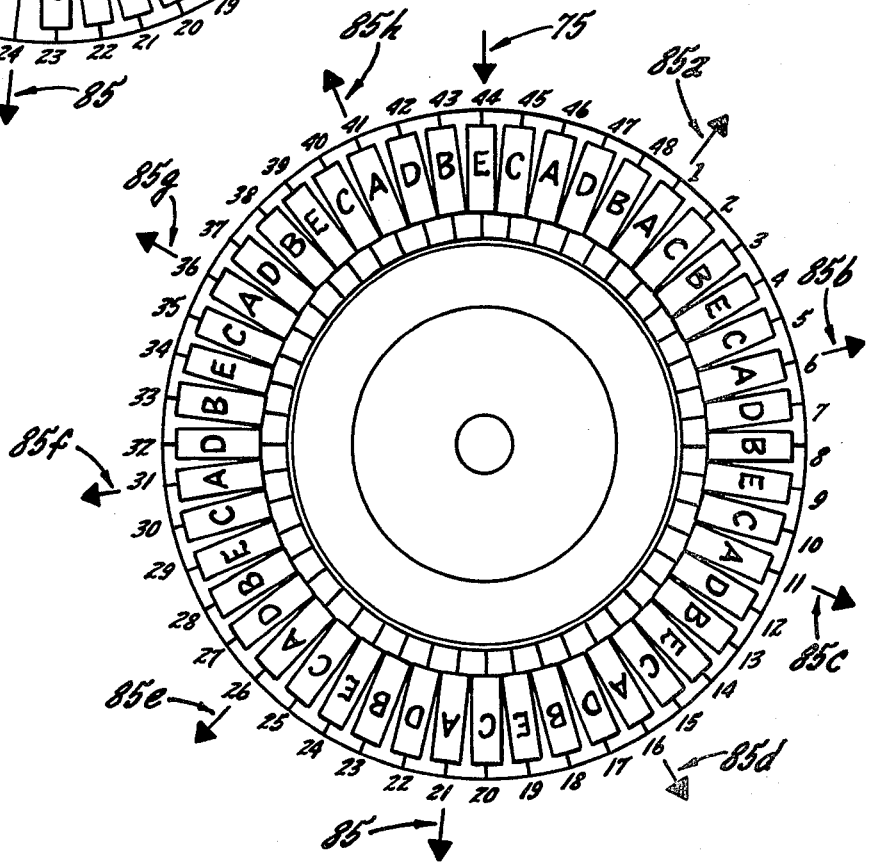

The hearth 60 then is advanced through nine additional steps of distance G to cause pockets Nos. 4, 9, 14, 19, 24, 29, 34, 39 and 44 to stop at the loading position 75 to receive billets indicated as E in FIG. 10. At this time, the hearth has rotated through a total of 1762.5 degrees and all of the pockets have received billets as shown in FIG. 10. On the next step of distance G, pocket No. 1 is again advanced to the loading station 75 to complete five revolutions of the hearth and to complete one cycle.

Unloading of the hearth 60 may be effected in various ways. In the preferred embodiment, the unloading position 85 is located one station short of being diametrically opposite the loading position 75. In other words, the unloading position 85 is spaced from the loading position in the direction of rotation of the hearth by an angular distance equal to 180 degrees minus the angular distance F between adjacent pockets 70. During the fifth revolution of the hearth, pocket No. 1 stops at the unloading position 85 and thus the billet A in that pocket may be discharged at the unloading position so that pocket No. 1 will be empty and may be re-loaded upon returning to the loading position 75 when the hearth completes its fifth revolution. After pocket No. 1 stops at the unloading position 85 during the fifth revolution, the other pockets successively stop at that position in the order referred to above during successive dwell periods of the hearth. With the discharge position 85 located as shown, four pockets simultaneously will be empty during the final one-half revolution of the hearth in a five revolution cycle. For example, pockets Nos. 1, 6, 11 and 16 will be empty during the last one-half revolution of the cycle if each of those pockets is unloaded at the unloading position 85.

It is preferred to locate the unloading position at 85 as shown in the drawings because the unloading position is located almost diametrically opposite the loading position 75 and thus material handling equipment for unloading the heath 60 and transferring billets 51 away from the furnace 50 may be positioned so as to not be encumbered by material handling equipment for delivering billets to the furnace and loading the hearth. Also, the nearly diametrically opposite location of the unloading position 85 from the loading position 75 promotes an efficient in-line flow of billets through the furnace to the forging apparatus. Other unloading positions may be established, however, such as the positions indicated by 85*a*, 85*b*, 85*c*, 85*d*, 85*e*, 85*f*, 85*g* and 85*h* as shown in FIG. 10 with each of these positions being spaced from the loading position 75 in a direction (i.e., clockwise) opposite to the direction of rotation (i.e., counterclockwise) of the hearth and by an angular distance which is a whole multiple of the index distance G. If the unloading position is located at 85*a*, only one pocket will be empty during the final one-half revolution of the hearth 60 in a five revolution cycle and thus the retention time of the billets 51 in the furnace 50 may be increased. If the unloading position is located at certain places such as, for example, position 85*h*, it may be desirable to rotate the hearth 60 in a clockwise direction in order to increase the retention time and to minimize the number of empty pockets during the final revolution.

It is preferable that the index distance G be selected so as to be the smallest possible distance which results in a non-integer quotient when 360 degrees is divided by G. For example, where the hearth includes 48 pockets 70, the smallest possible distance G which results in a non-integer quotient when 360 degrees is divided by G is 37.5 degrees. The next smallest possible distance G resulting in a non-integer quotient is 52.5 degrees but, if the hearth were indexed through steps of that distance, seven revolutions would be required to fill all 48 pockets. An index distance G which results in an integer quotient when 360 degrees is divided by the index distance should be avoided since the use of such an index distance would result in some pockets never being filled.

From the foregoing, it will be apparent that indexing of the hearth 60 in accordance with the principles of the present invention results in non-adjacent stations or pockets 70 of the hearth being loaded during successive dwell periods and yet enables all of the pockets to be ultimately loaded. As a result, newly loaded cold billets 51 are distributed among previously loaded hot billets so as to avoid creating cold and hot zones in different sections of the furnace chamber 57. Accordingly, a more even temperature distribution may be maintained around the chamber. In addition, the unloading position 85 can be variously located to best suit the physical layout around the furnace and to expedite the flow of billets through the furnace.

While an intermittently rotatable hearth 60 has been specifically disclosed, those familiar with the art will appreciate that some of the principles of the invention are also applicable to a hearth which is rotated continuously and in which the workpieces are loaded and unloaded on the "fly". In such an arrangement, the hearth could be rotated at a constant speed or alternatively could be rotated at a slow speed during loading and unloading and rotated at a faster speed at all other times.

I claim:

1. A method of operating a rotary hearth furnace having a heated chamber and having an intermittently rotatable hearth in said chamber for indexing workpieces step-by-step around a circle, said hearth having a plurality of angularly spaced workpiece stations which are spaced equally from one another by an angular distance F, said method comprising periodically indexing said hearth through equal steps each having a preselected angular distance G which is a whole multiple of said angular distance F whereby one station stops at a predetermined loading position when the hearth dwells between successive steps, and placing a workpiece in the station which stops at the loading position each time the hearth dwells, said method being characterized in that successive workpieces at said loading position are placed in non-adjacent stations during a first revolution of said hearth and are placed in intervening stations during a second revolution of the hearth.

2. A method as defined in claim 1 in which successive workpieces at said loading position are placed into other intervening stations during a third revolution of said hearth.

3. A method as defined in claim 2 in which successive workpieces at said loading position are placed into still other intervening stations during a fourth revolution of said hearth.

4. A method as defined in claim 3 in which successive workpieces at said loading position are placed into yet further intervening stations during a fifth revolution of said hearth.

5. A method as defined in any of claims 1, 2, 3 or 4 in which said angular distance G is selected such that the quotients resulting from dividing 360 degrees by G and by ½ G are non-integers.

6. A method of operating a rotary hearth furnace having a heated chamber and having an intermittently rotatable hearth in said chamber for indexing workpieces step-by-step around a circle, said hearth having a plurality of angularly spaced workpiece stations which are spaced equally from one another by an angular distance F, said method comprising periodically indexing said hearth through equal steps each having a preselected angular distance G which is a whole multiple of said angular distance F whereby one station stops at a predetermined loading position each time the hearth dwells between successive steps, and placing a workpiece in the station which stops at the loading position when the hearth dwells, said method being characterized in that said angular distance G is selected such that the quotients resulting from dividing 360 degrees by G and by ½ G are non-integers so that successively loaded workpieces are placed in non-adjacent stations during one revolution of said hearth and are placed in stations located between loaded stations during the next revolution of said hearth.

7. A method as defined in claim 6 in which the first station is loaded at the start of a given revolution and in which substantially all of said stations are loaded when said hearth completes a number of revolutions equal approximately to said whole multiple.

8. A method as defined in claim 7 in which said angular distance G is selected so as to be the smallest possible distance which results in a non-integer quotient when 360 degrees is divided by G.

9. A method as defined in claim 8 in which said angular distance F equals 7.5 degrees and in which said angular distance G equals 37.5 degrees.

10. A method as defined in any of claims 6, 7, 8 or 9 in which an unloading position is spaced around said furnace from said loading position in a direction opposite to the direction of rotation of said hearth and by an angular distance which is a whole multiple of said angular distance G, said method further comprising the step of unloading a workpiece from each station which stops at said unloading position each time said hearth dwells after substantially all of said stations have been loaded.

11. A method as defined in clam 10 in which said unloading position is approximately, but not exactly, diametrically opposite said loading position.

12. A method as defined in claim 11 in which said unloading position is spaced from said loading position in the direction of rotation of said hearth by an angular distance equal to 180 degrees minus said angular distance F.

13. A rotary hearth furnace having a chamber, means for heating said chamber, an intermittently rotatable hearth in said chamber for indexing workpieces step-by-step around a circle, said hearth having a plurality of angularly spaced workpiece stations which are spaced equally from one another by an angular distance F and which periodically dwell in a loading position, means in said loading position for placing a workpiece in each station when the station dwells at the loading position, and means for indexing said hearth through equal steps each having a preselected angular distance G which is a whole multiple of said angular distance F and which also is such that the quotients resulting from dividing 360 degrees by G and by $\frac{1}{2}$ G are non-integers whereby successively loaded workpieces are placed in non-adjacent stations during one revolution of said hearth and are placed in intervening stations during the next revolution of said hearth.

14. A rotary hearth furnace as defined in claim 13 in which said indexing means index said hearth through an angular distance G which is the smallest possible distance that results in a non-integer quotient when 360 degrees is divided by G.

15. A rotary hearth furnace as defined in either of claims 13 or 14 in which an unloading position is spaced around said furnace from said loading position in a direction opposite to the direction of rotation of said hearth and by an angular distance which is a whole multiple of said angular distance G, said furnace further including means in said unloading position for unloading a workpiece from each station which stops at said unloading positon each time said hearth dwells after substantially all of said stations have been loaded.

16. A rotary hearth furnace as defined in claim 15 in which said unloading position is approximately, but not exactly diametrically opposite said loading position.

17. A rotary hearth furnace as defined in claim 16 in which said unloading position is spaced from said loading position in the direction of rotation of said hearth by an angular distance equal to 180 degrees minus said angular distance F.

18. A method of operating a rotary hearth furnace having a heated chamber and having a rotatable hearth in said chamber for advancing workpieces around a circle, said hearth having a plurality of angularly spaced workpiece stations which are spaced equally from one another, said method comprising the steps of rotating said hearth in one direction within said chamber, and placing workpieces in said stations at said loading position, said method being characterized in that successive workpieces at said loading position are placed in non-adjacent stations during a first revolution of said hearth and are placed in intervening stations during a second revolution of the hearth.

* * * * *